US005398352A

United States Patent [19]

Kordelin

[11] Patent Number: 5,398,352

[45] Date of Patent: Mar. 21, 1995

[54] WC MODULE WITH WC BOWL FORMING PART OF WALL CONSTRUCTION

[75] Inventor: Tapio Kordelin, Turku, Finland

[73] Assignee: Oy Shippax Ltd., Turku, Finland

[21] Appl. No.: 150,169

[22] PCT Filed: Jun. 2, 1992

[86] PCT No.: PCT/FI92/00173

§ 371 Date: Nov. 29, 1993

§ 102(e) Date: Nov. 29, 1993

[87] PCT Pub. No.: WO92/22713

PCT Pub. Date: Dec. 23, 1992

[30] Foreign Application Priority Data

Jun. 10, 1991 [FI] Finland ..... 912774

[51] Int. Cl.[6] ..... A47K 4/00; E03C 1/01

[52] U.S. Cl. ..... 4/662; 4/664

[58] Field of Search ..... 4/662, 663, 664, 665

[56] References Cited

U.S. PATENT DOCUMENTS

| | | | |
|---|---|---|---|
| 3,015,110 | 1/1962 | Treand | 4/663 |
| 3,755,826 | 9/1973 | Roberts | 4/662 |
| 3,905,048 | 9/1975 | Moller | 52/34 |
| 4,233,692 | 11/1980 | Sinsley | 4/662 |
| 4,338,690 | 7/1982 | Hsieh et al. | 4/300 |
| 5,093,941 | 3/1992 | Müller | 4/479 |

FOREIGN PATENT DOCUMENTS

| | | | |
|---|---|---|---|
| 0235008 | 9/1987 | European Pat. Off. | 4/664 |
| 0426976 | 5/1991 | European Pat. Off. . | |
| 0136355 | 1/1934 | Germany | 4/662 |
| 87682 | 10/1936 | Sweden . | |
| 1180565 | 2/1970 | United Kingdom | 4/664 |
| 2123046 | 1/1984 | United Kingdom | 4/662 |

*Primary Examiner*—Robert M. Fetsuga

*Attorney, Agent, or Firm*—Burns, Doane, Swecker & Mathis

[57] ABSTRACT

A WC module which is ready to be installed into place and to be connected to the water and sewer connections is described. The module has been formed so that its inner wall and WC bowl are of the same piece. Above the WC bowl are situated seat boards which are fixed to the inner wall by a hinge so that the seat boards can be turned into an upright position when they are not in use. The module is formed of two elements in the rear part of which are situated the technical devices relating to the functioning of the WC module, such as the WC bowl, the water tank, etc., and the front part of which incorporates a door.

11 Claims, 4 Drawing Sheets

WC MODULE WITH WC BOWL FORMING PART OF WALL CONSTRUCTION

BACKGROUND OF THE INVENTION

The present invention relates to a WC module which can be installed in any public premises, such as a railway station, airport, market place etc. It can also be installed, for example, in connection with a ship cabin., as WC premises.

According to a known method, WC modules are constructed so that all the fixtures required, such as the WC bowl, washbasin etc are already installed in the WC premises at the factory. Thus, at the installation site these fixtures only need to be connected to the water pipes and sewer. Thanks to the preliminary work carried out at the factory, significantly less valuable installation time is spent on constructing the WC module on site.

Despite the work done at the factory, however, WC premises have not become simpler. All fixtures still require their own space in the WC. Due to the complexity of the premises, cleaning them is also inconvenient.

SUMMARY

An object of the present invention is, therefore, to achieve a WC module, which is essentially simpler than present premises and thus also more efficient in use and easier to clean. According to the invention, the module does not have a separate WC bowl, but it is incorporated directly as a continuation of the wall structure of the module. Thus, the WC no longer has to be made of separate components. The design and structure of the WC module relating to the invention incorporates all the equipment necessary in a WC.

BRIEF DESCRIPTION OF THE DRAWINGS

The invention is exemplified below with reference to the appended drawings, in which.

DETAILED DESCRIPTION OF A PREFERRED EMBODIMENT

Figure 1:
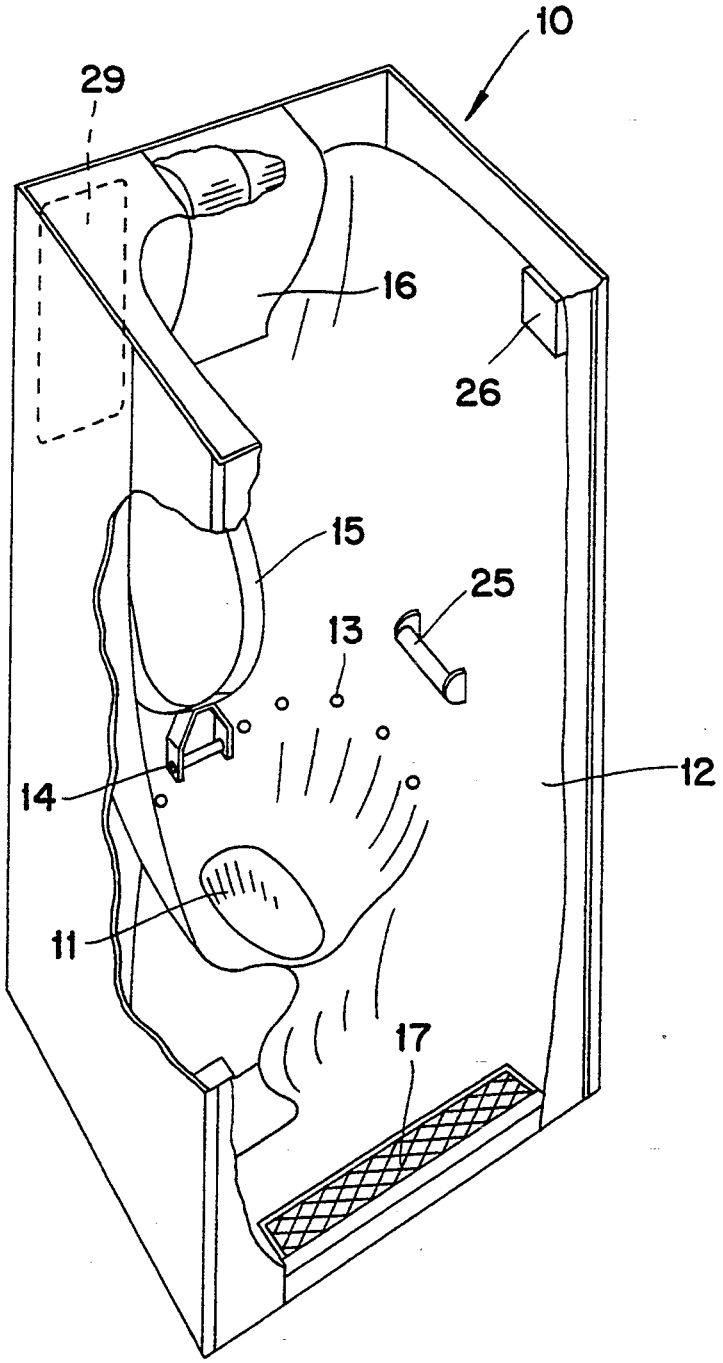
FIG. 1 shows a partly cross-sectional, perspective view of the WC module relating to the invention.

FIG. 1 shows a partly cross-sectional view of the WC module 10 relating to the invention. The figure shows that the module does not comprise a separate WC bowl 11. Instead, the inner surface of the module 10 is designed so that the WC bowl 11 is a direct continuation of the curved wall surfaces 12. The bowl 11 is flushed by running flushing water from the nozzles 13 on the wall 12 down the wall surfaces into the bowl 11. The water tank 29 can be situated in the upper part of the module, hidden behind the curved inner wall 12.

The module 10 does not comprise a traditional, fixed WC seat for sitting on either, because the WC bowl is an integral part of the wall. In the WC module relating to the invention, the WC seat is arranged so that on the rear wall of the module 10, there are seat boards 15, which are turned down on a hinge 14, and rise up again after use. Above the seat boards 15 is a toilet paper roll rack 16, because the toilet paper is also used as covering for the seat 15. The paper is, therefore, in sock-like form so that it can be pulled over the seat boards.

A handle 25 and a light fixture 26 are connected to the inner surface 12 of the WC module 10, and on the floor level a floor drain is formed, which is covered by a grating 17. A separate water feeder is led to the floor drain, which feeder flushes the space below the grating 17 at the same time as the WC bowl 11 is flushed.

Figure 2:
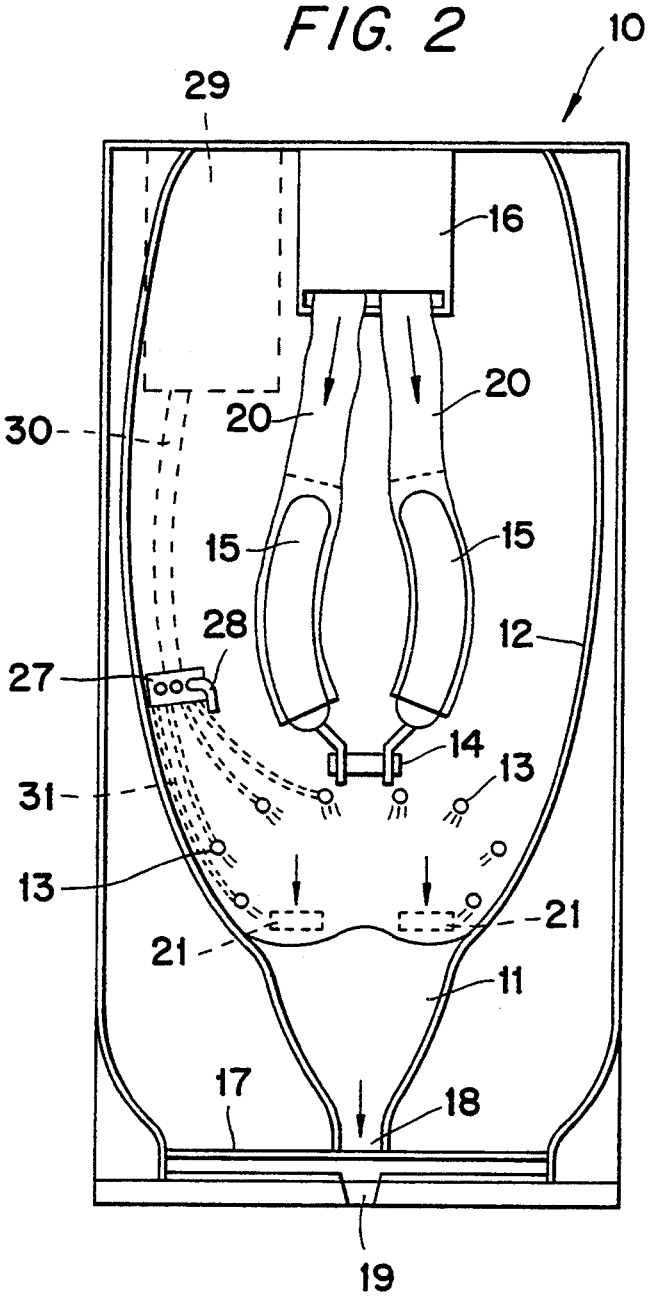
FIG. 2 shows the WC module of FIG. 1 as seen from the front.

FIG. 2 shows the WC module of FIG. 1 as seen from the front. It also clearly shows how the WC bowl 11 is a continuation of the curved walls 12. The flushing water is fed from nozzles 13 along the walls 12 into the bowl 11 and further on to the sewer 18. In this example, the nozzles are separate elements, but it is also possible to make a fold or other protrusion in the wall, which can as such act as a flushing water nozzle. The floor drain below the floor grating 17 is also connected to the sewer through opening 19.

The water tank 29 is shown in the figure by a broken line, and the water feeder pipe 30 projects downwards from it. The flushing water flows through a feeder valve in the wall, through the pipes 31, to the nozzles 13. FIG. 2 shows the panel 27 of the feeder valve which comprises a handle for flushing the WC bowl and a handle for the handwashing tap 28. Besides being flushed by means of a manual handle, the WC bowl flushing can alternatively be made automatic, so that whenever the seat boards 15 rise up, the WC bowl is flushed. The floor drain under the floor grating 17 would in that case also be flushed.

The WC seat consists of two seat boards 15, which are upright against the wall, below the toilet paper roll rack 16, when they are not in use. The figure shows that the upright storage position of the WC seat 15 has another function as well. Since the toilet paper 20 has been made into a tube, tubular covers can be pulled over the seat boards 15 from two separate toilet paper rolls. Cutting perforations are formed in the toilet paper at about 50 cm intervals. When the excess paper has been cut off, the seat 15 can be turned on the hinge 14 into the lower position, which is marked by reference number 21.

The raising of the seat 15 can be effected either by means of a counterweight or by a spring. It is advantageous arrange a short delay in the raising, so that the seat boards 15 are not raised too soon.

Figure 3:
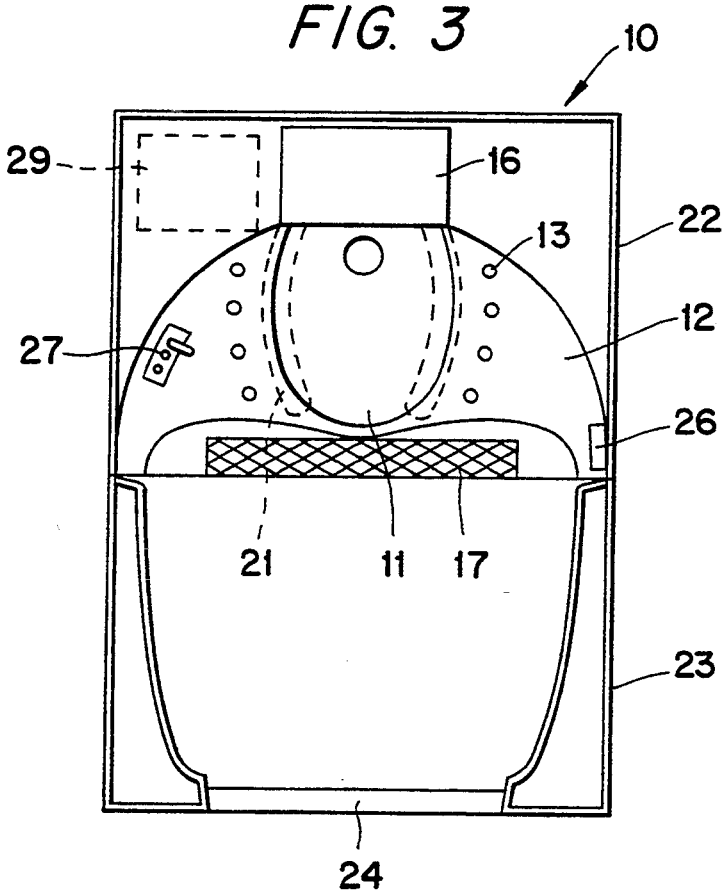
FIG. 3 shows the WC module as seen from above.

FIG. 3 shows the structure of the WC module relating to the invention as seen from above. The WC consists of two elements, which are the rear part 22 and the front part 23. All the functions and technical devices of the WC module are situated in the rear part 22. The front part 23 only comprises the door 24. This division is appropriate, firstly, because in this way all connections can be situated in the same place behind the module. Secondly, from the point of view of moulding technique, it is advantageous to make the curved parts 22 and 23 separately as shown. Thirdly, formed in this way, elements 22 and 23 are made sufficiently small so that they fit through the doors of already existing WC premises. This is significant when a WC is to be renovated by installing a new WC module relating to the invention in old premises.

The design of the WC seat 15 and of the other details of the module 10 may obviously vary. The exemplified embodiment is designed to be made of reinforced plastic.

Figure 4:
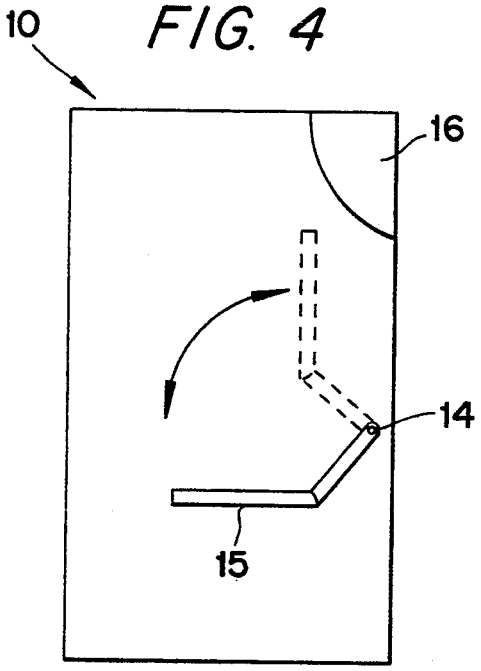
FIG. 4 shows diagrammatically a cross-section of the WC module as seen from the side.
Figure 5:
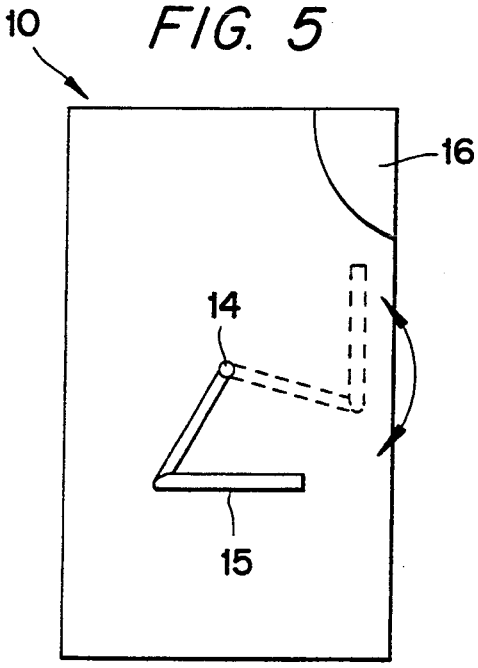
FIG. 5 corresponds to FIG. 4 and shows a second embodiment.

FIG. 4 shows diagrammatically the movement of the seat board 15 in the WC module. Hinge 14 may be situated on the rear wall of the module, as shown in the above figures. According to the embodiment shown in FIG. 5, the hinge 14 can, however, also be situated on the side walls, in which case the lifting movement of the seat boards 15 takes place in a different direction. The essential aspect is that the seat boards 15 are in their upright position directly below the toilet paper container 16, so that the cover paper can easily be pulled over the seat boards.

An essential part of the basic idea of the WC module relating to the invention is in fact its hygiene. It has no hollows, which might easily collect dirt. In principle the WC can be used without touching anything with the bare hands.

Figure 6:
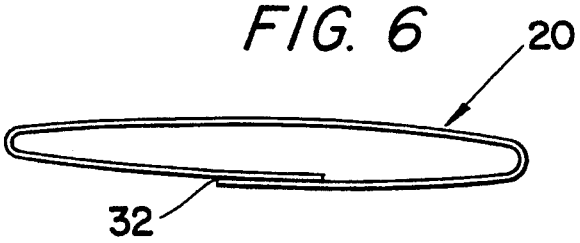
FIG. 6 shows a cross-section of the toilet paper intended for the WC module.
Figure 7:
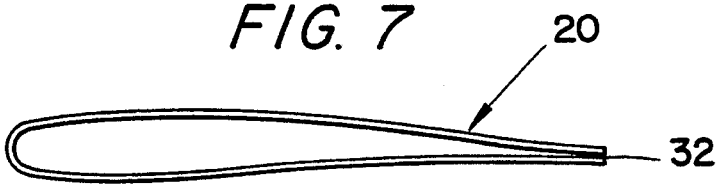
FIG. 7 corresponds to FIG. 6 and shows a second embodiment of the toilet paper.
Figure 8:
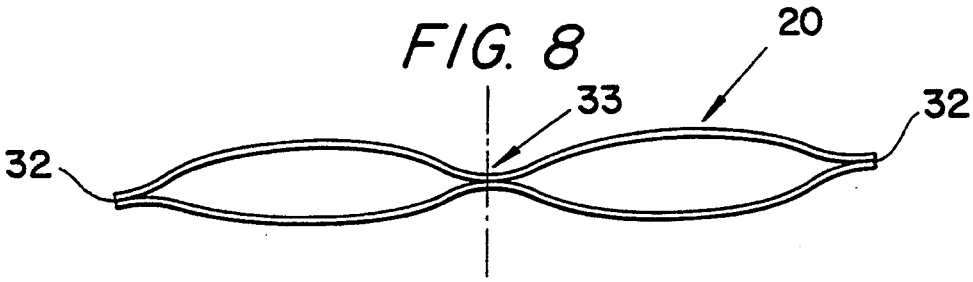
FIG. 8 corresponds to FIG. 6 and shows a third embodiment of the toilet paper.

The hygiene is achieved through the advantageous structure and efficient functioning of the devices. An important part is also played by the toilet paper relating to the invention, the cross-section of which is shown in FIG. 6. The paper is folded into a closed tube, which is seamed at point 32. The seam 32 can also be on the side, as shown in FIG. 7. According to the third embodiment shown in figure 8, the toilet paper 20 can be made in advance to consist of two parts. In this case there are similar seams 32 as in FIG. 7 on the sides, but also perforations at the seam 33 in the middle of the paper web, so that the wed can easily be divided into two tubular strips.

It is obvious to a person skilled in the art that the different embodiments of the invention may vary within the scope of the claims given below.

I claim:

1. A WC module, comprising:

an upright wall member formed to define an enclosure, said wall member including an access opening in one side thereof, said wall member further including a unitary inner surface extending around said enclosure; and a WC bowl formed in a lower portion of said wall member, said bowl including an upper inlet opening and a lower outlet opening;

wherein a portion of said inner surface of said wall member extends from above said inlet opening to said outlet opening thereby also defining an inner surface of said bowl, said portion of said inner surface continuously sloping toward said outlet opening in a substantially linear manner.

2. A WC module as claimed in claim 1 further comprising an outer surface and a flushing water tank situated in an upper part of the WC module, between the inner surface and the outer surface, and that in the inner surface at least one nozzle is formed to direct flushing water into the WC bowl.

3. A WC module as claimed in claim 2, further comprising a pair of seat boards, which are fixed to the inner surface of the WC module above the WC bowl by means of a hinge, so that the seat boards can be turned into an upright position when they are not in use.

4. A WC module as claimed in claim 3, wherein on the inner surface of the WC module, above the seat boards, is installed toilet paper roll means for storing toilet paper and, from which toilet paper can be pulled as a cover over the seat boards.

5. A WC module as claimed in claim 4, wherein to the inner surface of the WC module is attached a light fixture and an operating panel of a water feeder valve, the said panel comprising a handle for flushing the WC bowl and a handle for a hand-washing tap.

6. A WC module as claimed in claim 5, wherein the WC module is formed of two elements in a rear part of which are situated the WC bowl, the seat boards, the toilet paper roll means, the light fixture, the operating panel, the water tank, and water, sewer and electrical connections, and that a front part incorporates a door.

7. A WC module as claimed in claim 1, further comprising on a floor level of the WC module a floor drain covered with a grating, the drain being connected to a sewer, and the floor drain is arranged to be flushed at the same time as the WC bowl is flushed.

8. A WC module as claimed in claim 7, further comprising a pair of seat boards, which are fixed to the inner surface of the WC module above the WC bowl by means of a hinge, so that the seat boards can be turned into an upright position when they are not in use.

9. A WC module as claimed in claim 8, wherein on the inner surface of the WC module, above the seat boards, is installed toilet paper roll means for storing toilet paper and from which toilet paper can be pulled as a cover over the seat boards.

10. A WC module as claimed in claim 9, wherein the toilet paper roll means includes paper, which can be pulled over both seat boards.

11. A WC module as claimed in claim 1, wherein to the inner surface of the WC module is attached a light fixture and an operating panel of a water feeder valve, the panel comprising a handle for flushing the WC bowl.

* * * * *